US009803912B2

(12) United States Patent
Graham

(10) Patent No.: US 9,803,912 B2
(45) Date of Patent: Oct. 31, 2017

(54) CONDENSATE EVAPORATOR FOR REFRIGERATION APPARATUS

(75) Inventor: Thomas Graham, Ocean, NJ (US)

(73) Assignee: COMPONENT HARDWARE GROUP, INC., Lakewood, NJ (US)

( * ) Notice: Subject to any disclaimer, the term of this patent is extended or adjusted under 35 U.S.C. 154(b) by 2052 days.

(21) Appl. No.: 12/806,571

(22) Filed: Aug. 17, 2010

(65) Prior Publication Data

US 2012/0042676 A1 Feb. 23, 2012

(51) Int. Cl.
*F25D 21/08* (2006.01)
*F25D 21/14* (2006.01)

(52) U.S. Cl.
CPC ..... *F25D 21/14* (2013.01); *F25D 2321/1413* (2013.01); *F25D 2321/1442* (2013.01)

(58) Field of Classification Search
CPC ..... F25D 21/14; F25D 2321/1413
USPC ..... 62/275, 291, 285, 150, 151, 154, 80, 82
See application file for complete search history.

(56) References Cited

U.S. PATENT DOCUMENTS

| | | | | |
|---|---|---|---|---|
| 3,679,867 | A * | 7/1972 | Canter | 392/403 |
| 4,509,339 | A * | 4/1985 | Mehlan et al. | 62/450 |
| 4,554,794 | A * | 11/1985 | Khan | 62/150 |
| 5,072,095 | A * | 12/1991 | Hoffmann | 219/432 |
| 5,694,785 | A * | 12/1997 | Balentine | 62/275 |
| 6,693,246 | B1 * | 2/2004 | Rudolph et al. | 200/1 B |

* cited by examiner

*Primary Examiner* — Frantz Jules
*Assistant Examiner* — Brian King
(74) *Attorney, Agent, or Firm* — Francis C. Hand; Carella, Byrne, et al.

(57) ABSTRACT

The condensate evaporator has a pan that is pivotally mounted on a fulcrum defined by two posts to depress the plunger of a switch as condensate collects in the pan. The switch and posts form a three point support for the pan on a flat surface. The switch is actuated by the pivoting of the pan to deliver power to a heater pad for heating the condensate.

3 Claims, 5 Drawing Sheets

CONDENSATE EVAPORATOR FOR REFRIGERATION APPARATUS

This invention relates to a condensate evaporator for refrigeration apparatus. More particularly, this invention relates to a condensate evaporator for large walk-in refrigerators.

As is known, large walk-in refrigerators are provided with condensate evaporators in order to collect and evaporate condensate that accumulates during operation of the refrigerators.

Generally, condensate evaporators for large walk-in refrigerators have been constructed to be slid into a space below a raised floor of the refrigerator to collect the condensate that forms during operation. Usually, the floor has been provided with a drain hole so that the evaporator may receive the condensate directly. These condensate evaporators typically employ electric heaters to evaporate the collected condensate.

A known condensate evaporator is presently constructed to use a "Balco" resistance wire in the heater. This wire when cold (when water is in the evaporator) has a low resistance and thus draws a high current in this state. After the water is all evaporated, the temperature of the wire increases, and so does the resistance of the wire, thus now drawing somewhat less power, though still using some electricity in this state. The wire is, thus "on" continuously 24/7 drawing this reduced amount of power unless more condensate enters the evaporator, cooling the wire, and then the wire returns to its lower resistance/higher current mode until the water is again evaporated. At all times, the heater is drawing power either at the full rate or at the reduced rate.

Accordingly, it is an object of the invention to provide a condensate evaporator that provides substantial energy savings.

It is another object of the invention to reduce the electrical energy required to operate a condensate evaporator in refrigeration apparatus.

It is another object of the invention to provide a simple, economical sensing device for sensing when condensate collected in a condensate evaporator is to be evaporated.

Briefly, the invention provides a condensate evaporator for refrigeration apparatus comprising a pan having a cavity in an upside for collecting condensate and a pair of studs on an underside for supporting the pan on a surface, for example, a floor under a raised floor of a walk-in refrigerator. The studs are positioned to allow the pan to pivot on the surface about a horizontal axis passing through the studs towards one end of the pan under the weight of condensate in the cavity.

The condensate evaporator also includes a heater pad on the pan for heating condensate in the cavity to a point of evaporation and a plunger type push button switch mounted at the end of the pan toward which the pan is able to pivot under the weight of condensate in the cavity of the pan.

The switch is positioned on the underside of the pan so that the two studs and switch support the pan at three points. The switch has a movably mounted plunger for movement between an extended position corresponding to a raised position of the end of the pan relative to the support surface and a retracted position corresponding to a lowered position of the end of the pan relative to the support surface. In this regard, the plunger is spring loaded by a spring that has a spring constant sufficient to support the pan with the two studs in a horizontal position on the support surface but insufficient to prevent the pan from pivoting about the two studs under the added weight of a predetermined amount of condensate in the pan. Once the pan has been emptied of this added amount of condensate, the spring returns the plunger to its extended position.

The condensate evaporator also includes an electrical circuit that electrically connects the heater pad and switch to an electrical supply whereby electrical power is supplied to the heater pad with the plunger of the switch in the retracted position and the electrical supply is interrupted to the heater pad with the plunger in the extended position thereof.

In accordance with the invention, the switch is normally in the off position, but turns on when a predetermined weight of water accumulates in the pan and pivots the pan so as to cause the plunger of the switch to recede to the retracted position thus sending power to the heater. After a sufficient amount of water has evaporated, the spring within the switch extends the plunger to its extended position thereby permitting the switch to turn off. Since the pan is still hot at this point, the pan continues to evaporate water, thus utilizing the energy put into the pan to initially heat the pan until equilibrium is reached. Thus, the pan is only "on" when there is a sizable amount of water therein, and totally off when sufficient water has been evaporated to de-activate the switch, thus realizing substantial energy savings without using complicated, failure-prone devices, such as floats, sensing circuits, and the like.

These and other objects and advantages of the invention will become more apparent from the following detailed description taken in conjunction with the accompanying drawings wherein.

Figure 1:
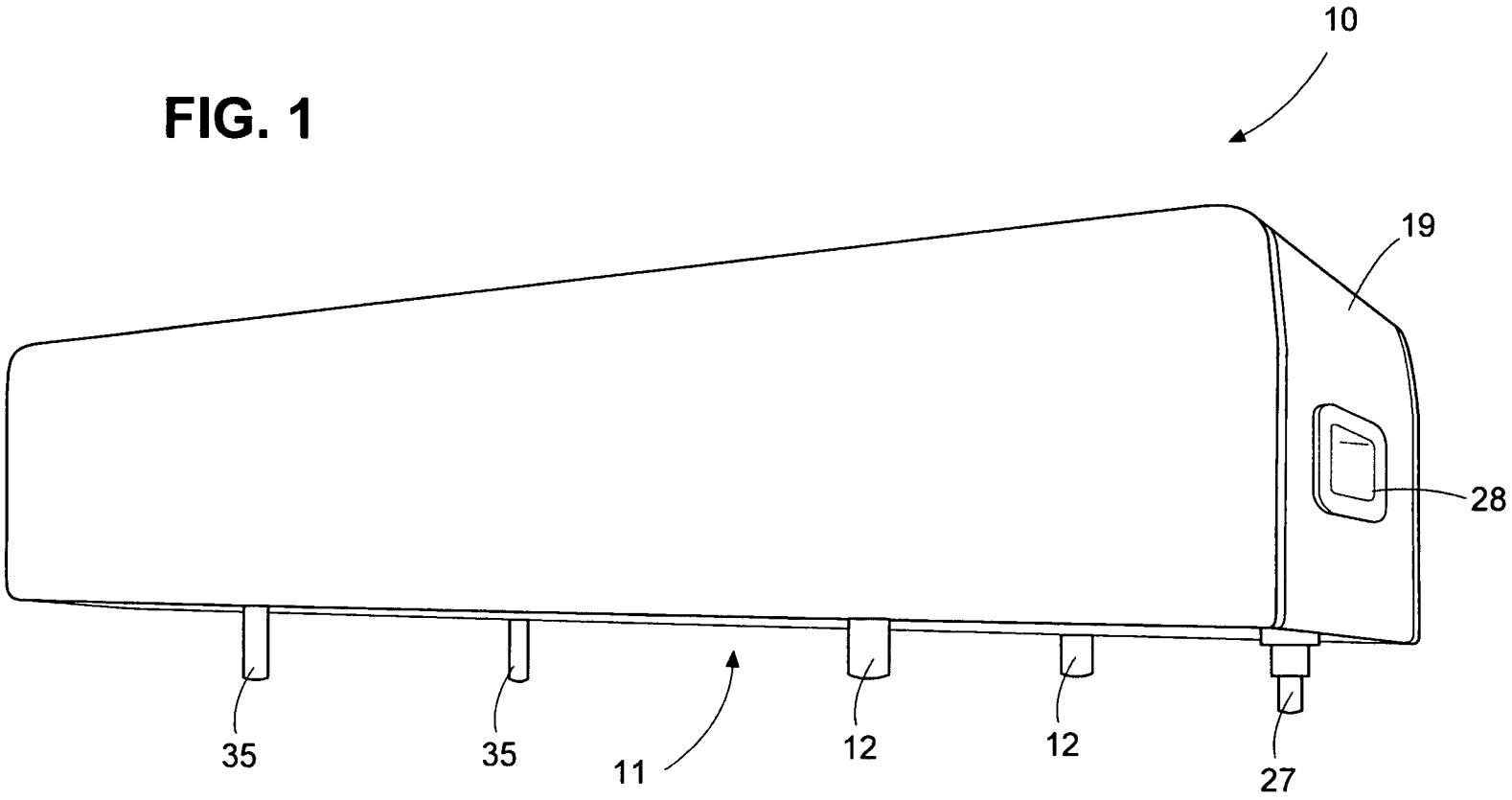
FIG. 1 illustrates a perspective view of a condensate evaporator in accordance with the invention.

Referring to FIG. 1, the condensate evaporator 10 is constructed for use in refrigeration apparatus for collecting and evaporating condensate that forms within the refrigeration apparatus.

In particular, the condensate evaporator 10 is constructed for use in a walk-in refrigerator having a raised floor. In this respect, the condensate evaporator 10 is sized to be slid into an opening below the floor of the walk-in refrigerator so as to collect condensate from a drain hole in the floor of the refrigerator.

As indicated, the condensate evaporator 10 has a pan 11 of elongated rectangular structure having a cavity for receiving condensate. The underside of the pan 11 is provided with two posts 12, each of which is located at or near a corner of one end of the pan 11. The topside of the pan 11 is open to receive condensate.

Figure 2:
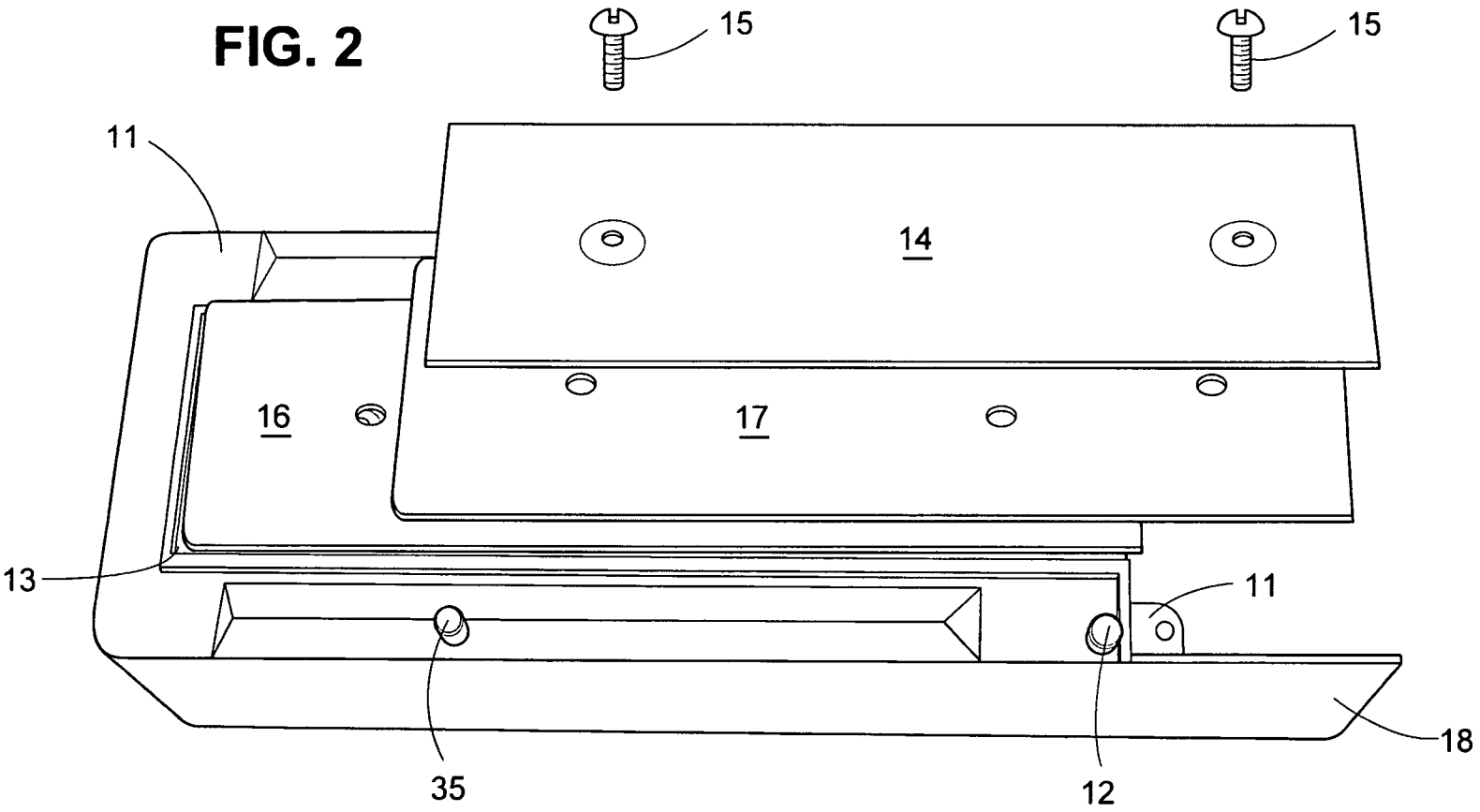
FIG. 2 illustrates an exploded view of the bottom of the condensate evaporator of FIG. 1.

Referring to FIG. 2, the pan 11 is provided with an elongated recess 13 in the underside as well as a cover plate 14, for example of aluminum, that is secured to the underside of the pan 11 by a pair of screws 15 to close off the recess 13 to the outside environment. The recess 13 is sized to receive a heater pad 16 made with a Balco resistance wire. In this respect, the heater pad 16 is clamped to the bottom of the pan 11 by the aluminum plate 14. In addition, a silicone foam pad 17 is provided between the heater pad 16 and the aluminum plate 14.

Figure 3:
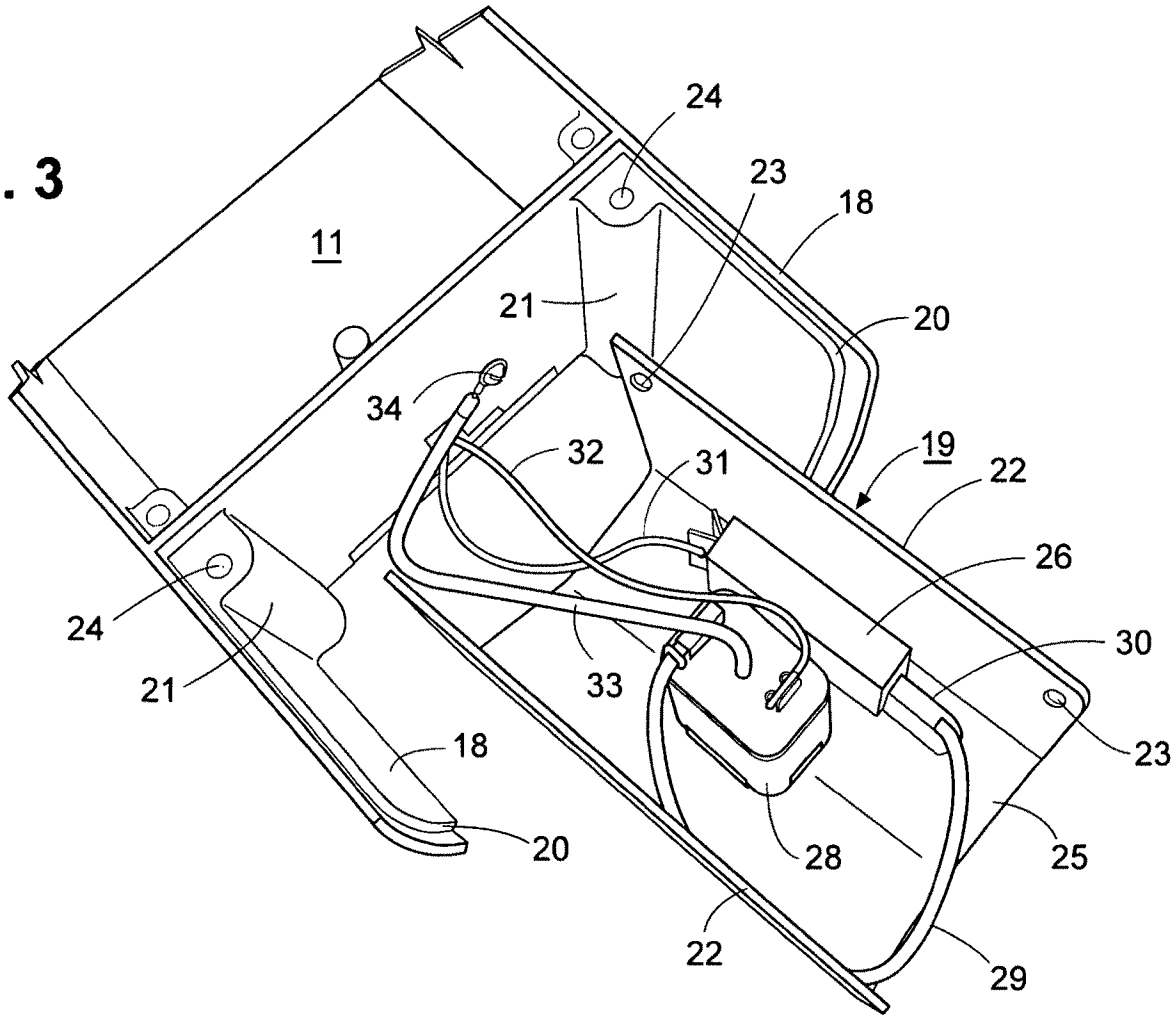
FIG. 3 illustrates a view of a switch as mounted in a removable housing on the condensate evaporator in accordance with the invention.
Figure 4:
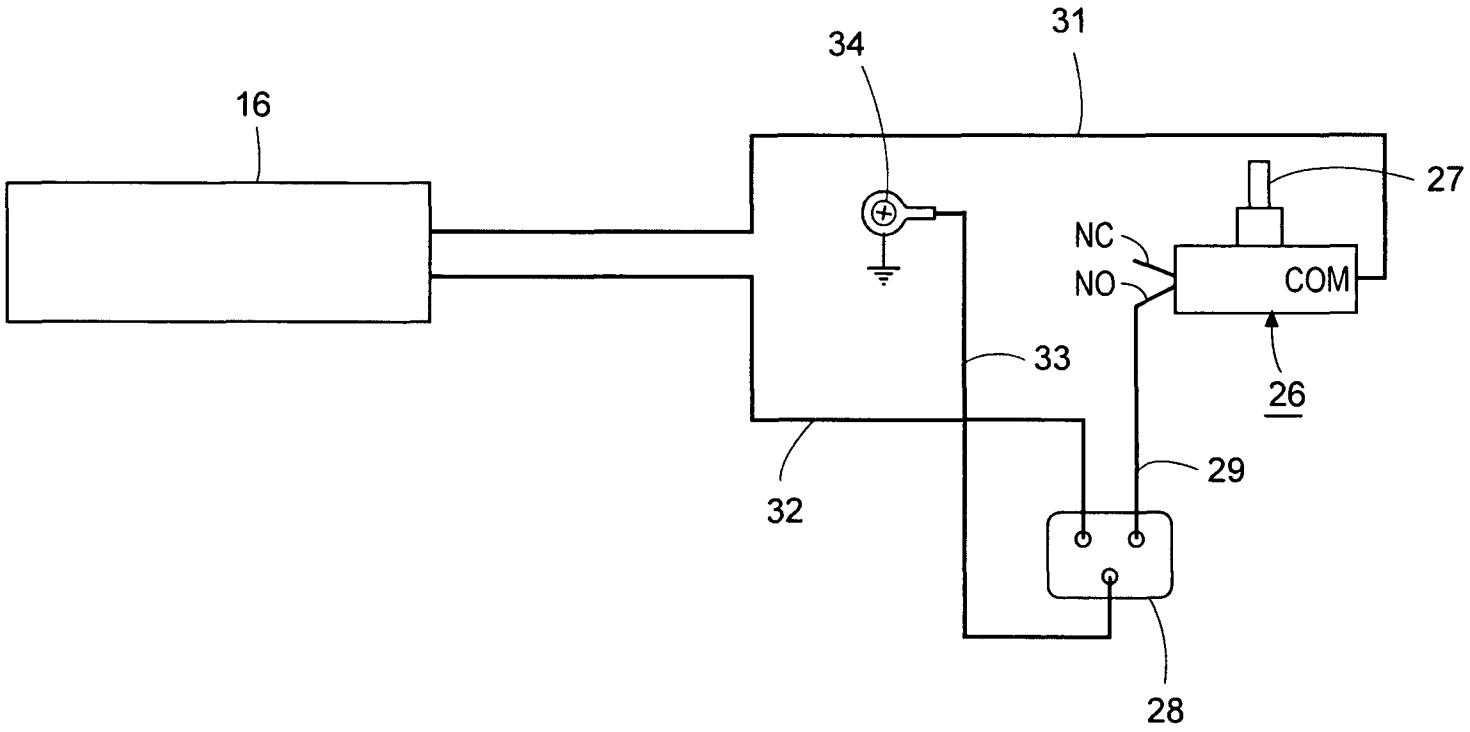
FIG. 4 illustrates a schematic diagram of an electrical circuit for the condensate evaporator in accordance with the invention.

Referring to FIG. 3, one end of the pan 11 is bifurcated with a pair of parallel flanges 18 that slidingly receive a removable U-shaped housing 19. Together with the two flanges 18, the housing 19 provides an enclosed compartment at the end of the pan 11. As illustrated, each flange 18 has a shouldered recess 20 at the periphery of each of three sides to receive the U-shaped housing 19 in recessed manner.

The pan 11 is also provided with a pair of enlarged piers 21 at the two corners where the flanges 18 meet the remainder of the pan 11.

The U-shaped housing 19 has a pair of parallel legs 22 that slide within the recesses 20 of the pan 11 in a flush manner to lie over the piers 21. Each leg 22 has a pair of openings 23 to match with threaded bores 24 in the enlarged piers 21. Four screws 36 (see FIG. 5) serve to secure the housing 19 to the pan 11 by passing through the openings 23 in the housing 19 into threaded engagement in the bores 24. The legs 22 extend from a flat body 25 of the housing 19 that serves as a face on the end of the evaporator 10

Figure 5:
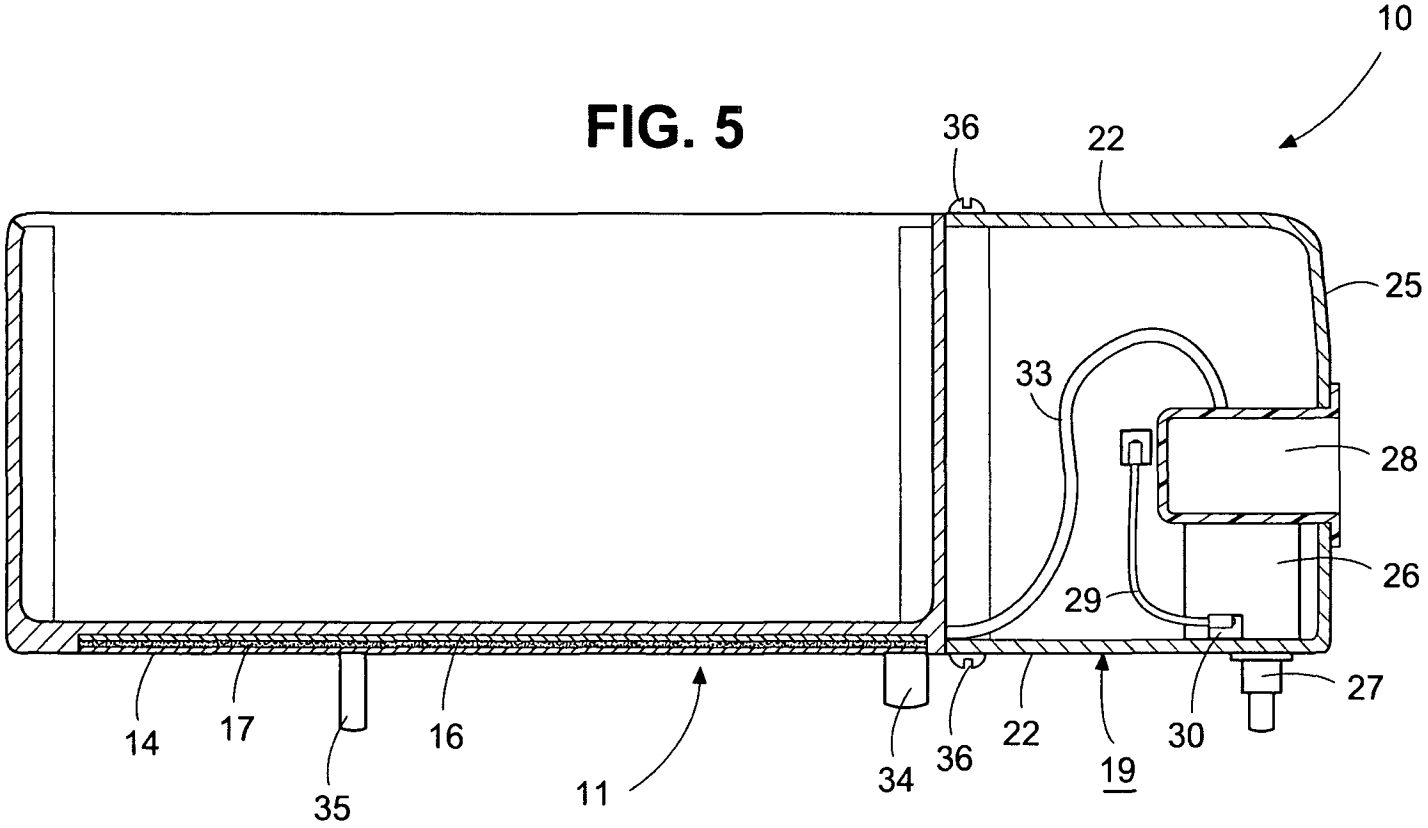
FIG. 5 illustrates a longitudinal cross-sectional view of the condensate evaporator of FIG. 1.

Referring to FIGS. 3 and 5, a switch 26 is mounted on the inside of the housing 19 so as to be housed in within the compartment at the end of the pan 11. This switch 26 is mounted on the bottommost leg 22 of the housing 19 and includes a plunger 27 that extends through the bottommost leg 22 as indicated in FIGS. 1 and 5.

In addition, a power inlet 28, such as a T12-X035 male snap-in power inlet, is mounted on the body 25 of the housing 19. As illustrated in FIG. 1, the power inlet 28 has an exposed entry in the face of the evaporator 10 to receive a power cord plug in a conventional manner.

Referring to FIGS. 3 and 5, the power inlet 28 is connected via a lead 29 to a COM contact 30 of the switch 26; the switch 26 has N.O. contact connected via a lead 31 to the heater pad 16; and the heater pad 16 is connected to the power inlet 28 via a lead 32 to complete a circuit. A third lead 33 from the power inlet 28 is connected to the pan 11 by a screw 34 to serve as a ground.

Referring to FIG. 1, the underside of the pan 11 is also provided with a pair of posts (or studs) 35 at an intermediate point of the pan 11 for supporting the pan 11 on a flat surface, for example, a floor under a raised floor of a walk-in refrigerator. The posts 35 extend from the pan 11 slightly more than the two cast on posts 12 at the corners of the pan 11 and are positioned to act as a fulcrum about which the pan 11 pivots when sufficient water is in the cavity of the pan 11. In this regard, the posts 35 are positioned closer to the end of the pan 11 that is opposite from the end of the pan 11 on which the U-shaped housing 19 is mounted, i.e. the end at which the plunger 27 of the switch 26 is mounted.

When placed on a flat support surface, the pan 11 is supported at three points, namely by the two intermediately disposed posts 35 and the plunger 27 of the switch 26. The posts 35 and the plunger 27 define a triangular array on the underside of the pan 11 for supporting the pan 11 on the flat surface.

The plunger 27 of the switch 26 is spring loaded by a spring (not shown) that has a spring constant which is sufficient to hold the pan 11 in the horizontal position indicated in FIG. 1 on a flat surface when the pan 11 is empty but insufficient to prevent the pan 11 from pivoting under the added weight of a predetermined amount of condensate in the pan 11 about the fulcrum provided by the two posts 35. Thus, after the evaporator pan 11 has been positioned within a refrigerator to collect condensate from the refrigerator, the pan 11 is in the position shown in FIG. 1.

As condensate begins to fill the cavity of the pan 11, the weight of the condensate causes the plunger 27 to begin to depress towards an actuation point thereby allowing the pan 11 to pivot about the two posts 35 in the direction of the end of the pan 11 in which the plunger 27 of the switch 26 is located. As the weight of the water increases, the amount of retraction of the plunger 27 into the switch 26 increases.

Once the plunger 27 has retracted to an actuation point, the switch 26 closes and power is delivered to the heater pad 16 causing the pad 16 to heat the pan 11 and, thus, the condensate within the pan 11.

As the condensate evaporates from the pan 11, the weight of water within the pan 11 begins to decrease thereby allowing the pan to pivot under the force of the spring on the plunger 27 of the switch 26. At some point, the plunger 27 is extended from the switch 26 an amount sufficient to cause the switch 26 to "open" and, thus, interrupt the power supply to the heater pad 16. That is, the switch 26 has a deactivation point between the retracted position of the plunger 27 and the extended position of the plunger 27 at which the electrical circuit interrupts the electrical supply to the heater pad 16. At this time, the pan 11 is in a slightly tilted position due to the weight of the remaining water in the pan 11. However, the water and pan 11 remain sufficiently hot to continue to evaporate the water in the pan 11. Eventually, as the water is evaporated, the pan 11 returns to a horizontal position with the plunger 27 in the fully extended position.

The invention thus provides a condensate evaporator that provides substantial energy savings, in particular, the invention reduces the electrical energy required to operate a condensate evaporator in refrigeration apparatus.

The invention further provides a simple, economical sensing device in the form of a plunger type push button switch for sensing when condensate collected in a condensate evaporator is to be evaporated.

In accordance with the invention, a pan of conventional structure such as one having four corner located posts as described above may be modified so as to be retrofitted with the two posts for pivoting of the pan and the switch. In this respect, the four cast on posts need not be removed when the studs and switch are added.

A tool to make the pan may have removable pins to be able to make (1) a conventional pan with four corner posts and no intermediately disposed posts, or (2) a pan with two corner posts and two intermediately disposed posts for use with a switch as described above.

What is claimed is:

1. A condensate evaporator comprising a pan having a cavity for receiving condensate therein and a pair of posts on an underside of said pan for pivoting of said pan on a surface about a horizontal axis passing through said posts towards one end of said pan under the weight of condensate in said cavity; wherein said pan is of elongated rectangular structure having said cavity therein and having a second pair of posts on an underside thereof at said one end of a shorter length than said first pair of posts a heater pad on said pan for heating condensate in said cavity to a point of evaporation;

a plunger type push button switch mounted on said underside of said pan at said end of said pan, said switch having a movably mounted vertically disposed plunger for movement between an extended position corresponding to a raised position of said end of said pan relative to said surface and a retracted position corresponding to a lowered position of said end of said pan relative to said surface; and an electrical circuit electrically connecting said heater pad and said switch to an electrical supply whereby electrical power is supplied to said heater pad with said plunger in said retracted position thereof and electrical supply is interrupted to said heater pad with said plunger in said extended position thereof.

2. A condensate evaporator as set forth in claim 1 wherein said second pair of posts is positioned between said first pair of posts and said plunger type push button switch.

3. A condensate evaporator for refrigeration apparatus comprising a pan having a cavity for receiving condensate therein and a fulcrum on an underside for pivoting of said pan on a horizontal surface towards one end of said pan under the weight of condensate in said cavity;

a heater pad on said pan for heating condensate in said cavity;

a switch mounted on said underside of said pan at said end of said pan, said switch having a movably mounted vertically disposed plunger for movement between an extended position corresponding to a raised position of said end of said pan relative to said surface and a retracted position corresponding to a lowered position of said end of said pan relative to said surface;

wherein a pair of posts define said fulcrum with said posts and said plunger defining a triangular array on said underside of said pan for supporting said pan on said horizontal surface; and an electrical circuit electrically connecting said heater pad and said switch to an electrical supply whereby electrical power is supplied to said heater pad with said plunger in said retracted position thereof and electrical supply is interrupted to said heater pad with said plunger in said extended position thereof.

* * * * *